United States Patent [19]

Simpson

[11] Patent Number: 4,569,678

[45] Date of Patent: Feb. 11, 1986

[54] METHOD FOR REMOVING PYRITIC, ORGANIC AND ELEMENTAL SULFUR FROM COAL

[76] Inventor: Charles H. Simpson, 7749 E. Chaparral Rd., Scottsdale, Ariz. 85253

[21] Appl. No.: 614,214

[22] Filed: May 25, 1984

[51] Int. Cl.[4] ..... C10L 9/02; C10L 9/06

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 2,369,024 | 2/1945 | Crecelius | 44/4 |
| 3,960,513 | 6/1976 | Agarwal et al. | 44/1 SR |
| 3,993,455 | 11/1976 | Reggel et al. | 44/1 SR |
| 4,022,588 | 5/1977 | Dessau | 44/1 SR |
| 4,127,390 | 11/1978 | Dondelewski | 44/1 SR |
| 4,305,726 | 12/1981 | Brown, Jr. | 44/1 SR |

*Primary Examiner*—Carl F. Dees

*Attorney, Agent, or Firm*—Sughrue, Mion, Zinn, Macpeak and Seas

[57] ABSTRACT

A process for removing sulfur and ash from coal and other carbonaceous materials involving treating an aqueous slurry of coal or other carbonaceous materials at an elevated temperature below the oxidation temperature of the coal or other carbonaceous materials in the presence of an oxidizing agent capable of reducing pyritic sulfides to a soluble state with: (A) an alkaline earth metal and/or alkali metal chloride, a catalyst comprising one or more deliquescent halogen compounds, barium chloride, potassium chloride or mixtures thereof, and one or more reducing oxides, chromate salts or mixtures thereof, and an inorganic acid, or (B) a formulation comprising one or more hypochlorites and the above-described catalyst or catalyst and acid. Sulfur is extracted as sulfate or other soluble sulfurs. In a second embodiment, elemental sulfur may be extracted intermediate to producing sulfate and other soluble sulfur by treating an aqueous slurry of the coal or other carbonaceous materials at an elevated temperature below the oxidation temperature of the coal or other carbonaceous materials with an alkaline earth metal and/or alkali metal chloride and nitric acid. In the second embodiment, sulfur can be extracted as sulfate or other soluble sulfurs by using the process of the first embodiment or by treating the extracted solids with an alkaline earth metal and/or alkali metal chloride and an inorganic acid at an elevated temperature below the oxidation temperature of the coal or other cabonaceous materials in the presence of an oxidizing agent capable of reducing pyritic sulfides to a soluble state.

48 Claims, 2 Drawing Figures

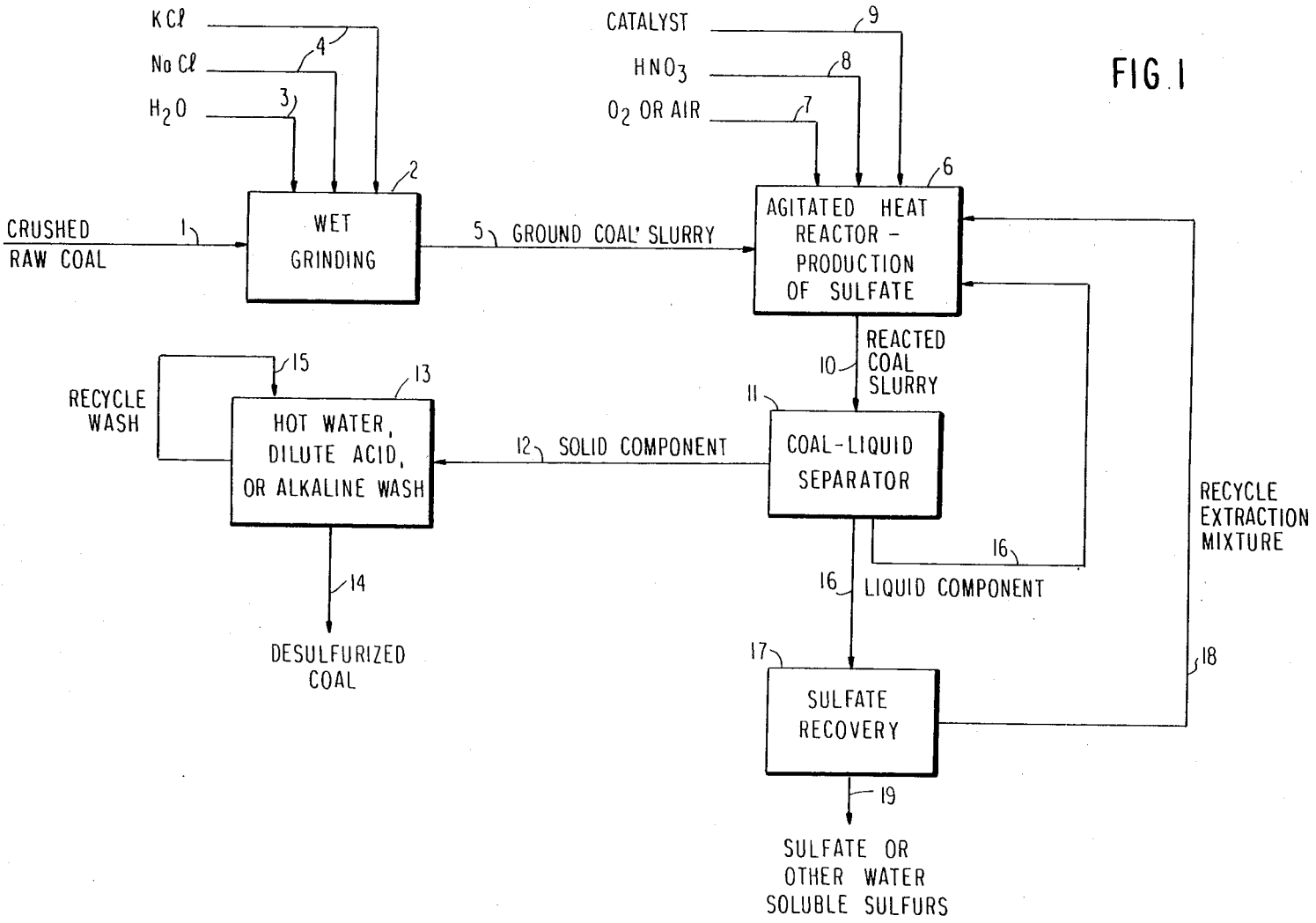
FIG. 1
CRUSHED RAW COAL
1
KCl
NaCl
$H_2O$
3
4
WET GRINDING
2
5 GROUND COAL SLURRY
CATALYST
$HNO_3$
$O_2$ OR AIR
7
8
9
AGITATED HEAT REACTOR - PRODUCTION OF SULFATE
6
REACTED COAL SLURRY
10
COAL-LIQUID SEPARATOR
11
12 SOLID COMPONENT
HOT WATER, DILUTE ACID, OR ALKALINE WASH
13
RECYCLE WASH
15
DESULFURIZED COAL
14
16 LIQUID COMPONENT
SULFATE RECOVERY
17
RECYCLE EXTRACTION MIXTURE
18
SULFATE OR OTHER WATER SOLUBLE SULFURS
19

METHOD FOR REMOVING PYRITIC, ORGANIC AND ELEMENTAL SULFUR FROM COAL

FIELD OF THE INVENTION

The present invention relates to a method for reducing the sulfur and ash content of coal or other carbonaceous materials. More particularly, the present invention relates to a chlorinolysis method for extracting pyritic, organic and elemental sulfur as well as ash from coal or other carbonaceous materials. In one embodiment of the present invention, the pyritic, organic and elemental sulfur may be largely removed in the form of sulfate sulfur. In a second embodiment of the present invention, sulfur is first removed which can be recovered as elemental sulfur, and then, a large proportion of the remaining sulfur is removed as sulfate sulfur. The present invention is particularly useful for removing organic sulfur from coal or other carbonaceous materials.

BACKGROUND OF THE INVENTION

Processes for desulfurizing coal are well known in the art. Most of these processes are useful for reducing the pyritic content of coal, but have little or no effect on reducing the organic or elemental sulfur in coal.

One process is set forth in U.S. Pat. No. 3,960,513 which discloses a process for reducing the amount of sulfur in coal by subjecting an aqueous slurry of coal to pressure oxygen leaching. In one embodiment, the aqueous solution may be acidic. However, this treatment removes mainly pyritic sulfur. Removal of organic sulfur requires an additional step of treating the coal with oxygen and a solvent such as ammonium hydroxide. Further, removal of the elemental sulfur requires a separate extraction with a solvent such as kerosene or toluene.

Removal of pyritic sulfur by means of an acid leach solution or an oxygen-containing gas is also disclosed in U.S. Pat. No. 4,083,696.

Another approach to removal of pyritic sulfur from coal is set forth in U.S. Pat. Nos. 3,926,575 and 3,768,988. This process comprises reacting finely divided coal with sulfuric acid and, optionally, hydrochloric acid to form ferric chloride which presumably reacts with the pyrite in the coal to generate free sulfur. In addition to an acid leach, a final solvent extraction step may be included to remove further free sulfur in the coal. If the solvent is para cresol, apparently a portion of organic sulfur compounds contained in the coal can also be removed.

U.S. Pat. No. 4,305,726 relates to a method for removing pyritic sulfur and ash from coal. The method involves treating coal with spent pickle liquor and reacting in the presence of hydrochloric acid, hypochorous acid and oxygen gas formed by adding the coal/pickle liquor mixture to a reactor with water and chlorine gas. After reaction, the ash is removed by mechanical means, for example by use of a weir.

In addition to the above-described desulfurization methods, methods are known which employ metal chloride salts. For example, U.S. Pat. No. 3,909,213 discloses a process for desulfurization of coal which comprises digesting coal with a Group IA or IIA metal oxide and a fused metal chloride salt such as zinc or ferric chloride. The medium is apparently capable of dissolving sulfur-containing organic compounds present in the coal. Anhydrous hydrogen chloride is passed through the digestion zone. U.S. Pat. No. 4,127,390 discloses a process employing an aqueous solution of sodium chloride for extracting pyritic sulfur from coal.

In addition to the numerous examples of processes set forth above, it is also known that organic sulfates can be extracted from coal by the use of solvents such as combustible sulfur solvents (U.S. Pat. No. 4,203,727) and chlorinated organic solvents (U.S. Pat. No. 4,081,250).

Despite the numerous above-described processes for desulfurizing coal, it is apparent that there still remains room for improvement. In particular, a more efficient, more economical method of desulfurizing coal and other carbonaceous materials would be desirable.

SUMMARY OF THE INVENTION

Accordingly, one object of the present invention is to provide a process for removing sulfur and ash from coal and other carbonaceous materials which removes not only pyritic sulfur, but also organic sulfur and elemental sulfur.

A further object of the present invention is to provide a process for removing sulfur and ash from coal which utilizes readily available, inexpensive chemical components.

A further object of the present invention is to provide a process for removing sulfur and ash from coal which will in a short period of time successfully remove large amounts of organic, sulfate and pyritic sulfur impurities from coal without chlorinating the coal and without losses of large amounts of the coal during the treatment process.

A further object of the present invention is to provide a process for removing pyritic sulfur, organic sulfur, elemental sulfur and ash from raw coal.

An even further object of the present invention is to provide a method for removing sulfur and ash from coal wherein the ash is removed in solution.

These and other objects have been achieved by providing a process for removing sulfur and ash from coal and other carbonaceous materials which contain pyritic sulfur, sulfides, elemental sulfur, organic sulfur and/or sulfate sulfur which comprises the steps of:

(I) treating an aqueous slurry of the coal or other carbonaceous materials at an elevated temperature below the oxidation temperature of the coal or other carbonaceous materials and in the presence of an oxidizing agent capable of reducing pyritic sulfides to a soluble state with (A) a formulation comprising:

(1) one or more alkaline earth metal chlorides, one or more alkali metal chlorides or a mixture of the chlorides, and (2) a treating agent comprising: (a) a catalyst comprising: (i) one or more deliquescent halogen salts, barium chloride, potassium chloride or mixtures thereof, and (ii) one or more reducing oxides, one or more chromate salts, or mixtures thereof, (iii) provided that if potassium chloride is not present in the slurry containing formulation (A), potassium fluoride or tannic acid is also present in the catalyst; and (b) an inorganic acid selected from the group consisting of: (i) hydrochloric acid, (ii) nitric acid, (iii) hydrochloric acid and nitric acid, (iv) hydrochloric acid and ferric chloride, and (v) nitric acid and ferric chloride, (3) provided that if iron is not present in the coal or other carbonaceous material, then ferric chloride is present in the slurry containing formulation (A), or (B) a formulation comprising:

(1) a hypochlorite or a mixture of hypochlorites, and (2) a treating agent comprising one member selected from the group consisting of (a) a catalyst comprising: (i) one or more deliquescent halogen salts, barium chloride, potassium chloride or mixtures thereof, and (ii) one or more reducing oxides, one or more chromate salts or a mixture thereof, (iii) provided that if potassium chloride is not present in the slurry containing formulation (B), potassium fluoride or tannic acid is also present in the catalyst, and (b) a mixture of (a) and an inorganic acid selected from the group consisting of (i) hydrochloric acid, (ii) nitric acid, (iii) hydrochloric acid and nitric acid, (iv) hydrochloric acid and ferric chloride, and (v) nitric acid and ferric chloride, (3) provided that if iron is not present in the coal or other carbonaceous materials, ferric chloride is present in the slurry containing formulation (B), whereby substantially all the sulfur extracted from said coal or other carbonaceous materials is converted to sulfate sulfur or other water soluble sulfates;

(II) separating the coal or other carbonaceous materials from solution; and (III) washing the separated coal or other carbonaceous materials.

In another embodiment, the present invention also provides a process for removing sulfur and ash from coal and other carbonaceous materials which contain pyritic sulfur, sulfides, elemental sulfur, organic sulfur and/or sulfate sulfur which comprises the steps of:

(I) treating an aqueous slurry of the coal or other carbonaceous materials at an elevated temperature below the oxidation temperature of the coal or other carbonaceous materials with a formulation comprising one or more alkaline earth metal chlorides, one or more alkali metal chlorides or a mixture of said chlorides and nitric acid, provided that if iron is not present in said coal or other carbonaceous materials, ferric chloride is also present, whereby substantially all the sulfur extracted from the coal or other carbonaceous materials can be removed as elemental sulfur;

(II) separating the coal or other carbonaceous materials from solution;

(III) agitating the separated coal or other carbonaceous materials at an elevated temperature below the oxidation temperature of the coal or other carbonaceous materials and in the presence of an oxidizing agent capable of reducing pyritic sulfides to a soluble state in an aqueous mixture containing:

(A) a formulation comprising (1) one or more alkaline earth metal chlorides, one or more alkali metal chlorides or a mixture of the chlorides, and (2) a treating agent comprising one member selected from the group consisting of: (a) an inorganic acid selected from the group consisting of: (i) hydrochloric acid, (ii) nitric acid, (iii) hydrochloric acid and nitric acid, (iv) hydrochloric acid and ferric chloride, and (v) nitric acid and ferric chloride, and (b) mixtures of (a) and a catalyst comprising: (i) one member selected from the group consisting of one or more deliquescent halogen salts, barium chloride, potassium chloride and mixtures thereof, and (ii) one or more reducing oxides, one or more chromate salts or mixtures thereof, (iii) provided that if potassium chloride is not present in the slurry containing formulation (A), potassium fluoride or tannic acid is also present in the catalyst, (3) provided that if iron is not present in the coal or other carbonaceous material, then ferric chloride is present in the slurry containing formulation (A); or (B) a formulation comprising:

(1) a hypochlorite or mixtures of hypochlorites, and (2) a treating agent comprising one member selected from the group consisting of: (a) a catalyst comprising: (i) one or more deliquescent halogen salts, barium chloride, potassium chloride or mixtures thereof, and (ii) one or more reducing oxides, one or more chromate salts or mixtures thereof, (iii) provided that if potassium chloride is not present in the formulation (B), potassium fluoride or tannic acid is also present in the catalyst, and (b) a mixture of (a) and an inorganic acid selected from the group consisting of (i) hydrochloric acid, (ii) nitric acid, (iii) hydrochloric acid and nitric acid, (iv) hydrochloric acid and ferric chloride, and (v) nitric acid and ferric chloride, (3) provided that if iron is not present in the coal or other carbonaceous materials, ferric chloride is present in the slurry containing formulation (B), whereby substantially all of the sulfur extracted from the separated coal or carbonaceous materials is converted to sulfate sulfur or other water soluble sulfurs;

(IV) again separating the coal or other carbonaceous materials from solution; and (V) washing the again separated coal or other carbonaceous materials.

In a further embodiment, elemental sulfur may be recovered at an intermediate stage in the latter described process by addition of a sulfur precipitant to the solution of step (II).

BRIEF DESCRIPTION OF THE DRAWINGS

FIG. 1 is a schematic diagram of one embodiment of the present invention wherein sulfur compounds, including pyritic sulfur, organic sulfur and elemental sulfur, in the coal are converted to sulfate or other water soluble sulfur compounds.

DETAILED DESCRIPTION OF THE INVENTION

Figure 2:
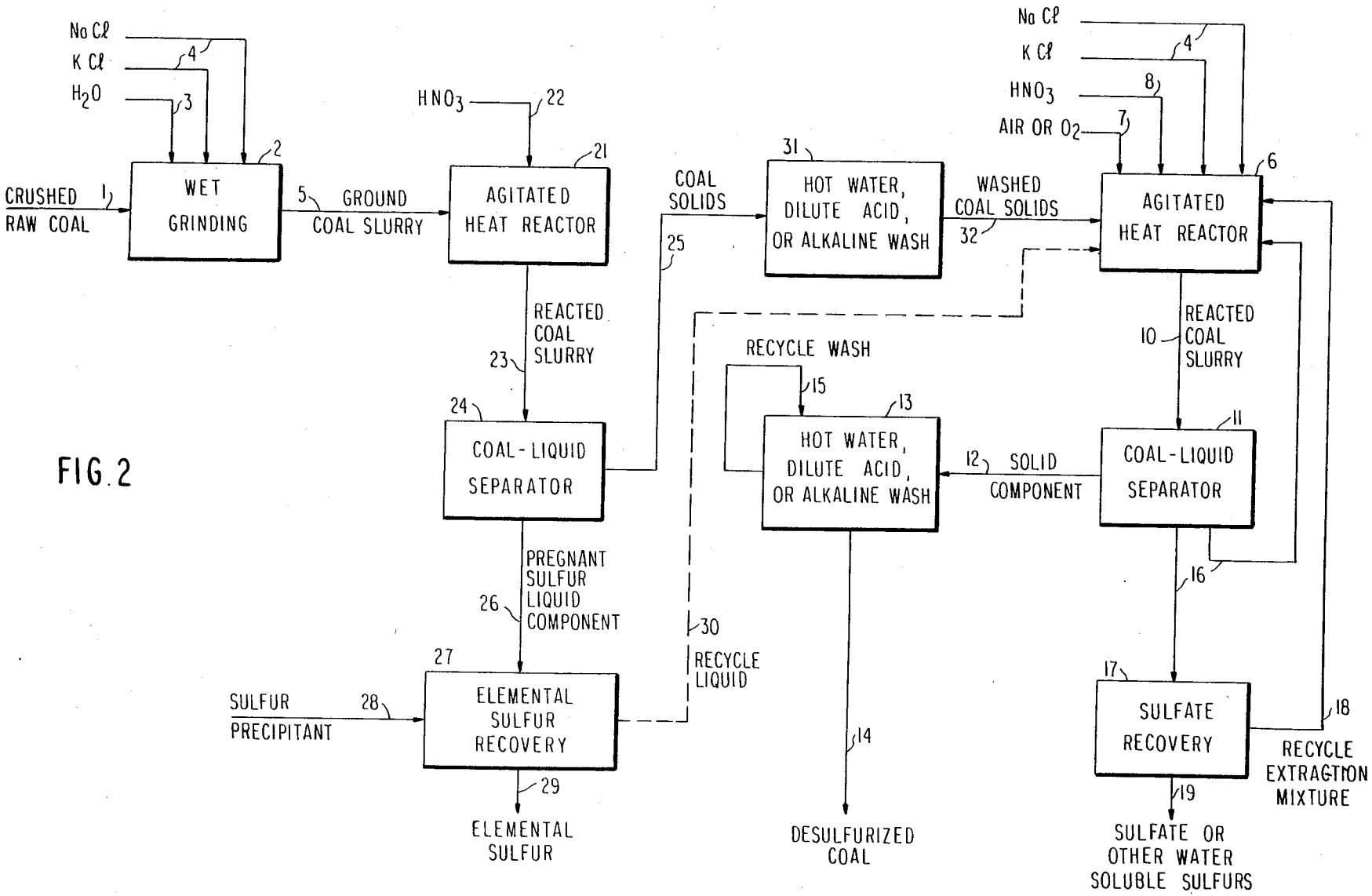
FIG. 2 is a second embodiment of the present invention wherein a portion of the sulfur compounds in the coal is recovered as elemental sulfur before treatment to form sulfate or other water soluble sulfur compounds.

The present invention is an improvement over the chlorinolysis process for desulfurizing raw mined coal disclosed in my patent application, U.S. Ser. No. 345,597 (now abandoned and expressly incorporated herein by reference).

According to the present invention, coal or other carbonaceous materials can be desulfurized and the ash solubilized. Examples of other carbonaceous materials include lignites, peats, shales, sands and solid coal derivatives, including bituminous, subbituminous and anthracitic. However, coal is preferred and raw coal, is even more preferred.

As used herein, raw coal is coal from which only the rock, dirt and sand have been removed.

Prior to being subjected to the process of the invention, raw coal is washed to remove shale, dirt and other gangue and is crushed to a standard ball mill feed size, i.e. to particles approximately three-fourths to one-half inch minus in size.

The particles are then fed into a ball mill and wet ground for reduction to about 100–300 mesh particles. Fine grinding of the coal is desired because it facilitates rapid interaction between sulfur compounds contained in the coal matrix and components in the extraction mixture.

If desired, comminuted coal can be sink floated before being combined with the extraction mixture. Sink floating removes sulfur-rich heavy particles from comminuted coal by utilizing a hydrocarbon solvent and other chemicals.

As used herein, the term extraction mixture refers to an aqueous solution containing, either separately or in combination, the following components of the present invention: one or more alkaline earth metals or alkali metal salts or mixtures thereof; one or more hypochlorites; one or more inorganic acids; one or more catalysts or catalyst components; an oxidizing agent; oxygen, oxygen enriched air, or air; and ferric chloride.

Further, unless otherwise specified, all concentrated solutions of hydrochloric acid are reagent grade concentrated hydrochloric acid, i.e., about 38% by weight; all concentrated solutions of nitric acid are approximately 68% by weight; all concentrated solutions of ferric chloride are 30% by weight; all concentrated solutions of sulfuric acid are approximately 98% by weight; and all concentrated solutions of acetic acid are approximately 100% by weight. All concentrated solutions of acids not specifically mentioned above are, unless otherwise specified, the commericially available reagent grade concentrated solutions.

In one embodiment of the present invention, an aqueous slurry of coal or other carbonaceous material containing pyritic sulfur, sulfites, elemental sulfur, organic sulfur and/or sulfate sulfur is treated with one or more alkaline earth metal chlorides, one or more alkali metal chlorides or a mixture of the chlorides and a treating agent comprising a catalyst and an inorganic acid at an elevated temperature in the presence of an oxidizing agent capable of reducing pyritic sulfides to a soluble state, provided that if iron is not present in the coal or other carbonaceous materials, ferric chloride is also present in the aqueous slurry containing the extraction mixture. Alternatively, the aqueous slurry is treated with a formulation comprising a hypochlorite or a mixture of hypochlorites and a catalyst or a catalyst and an inorganic acid at an elevated temperature in the presence of an oxidizing agent capable of reducing pyritic sulfides to a soluble state, provided that if iron is not present in the coal or other carbonaceous materials, ferric chloride is also present in the aqueous slurry containing the extraction mixture. In this embodiment, sulfur is removed as sulfate or other water soluble sulfurs.

Of the alkaline earth metal chlorides such as barium chloride, magnesium chloride and calcium chloride, calcium chloride is preferred. Of the alkali metal chlorides, sodium chloride, potassium chloride and mixtures thereof are preferred.

The alkaline earth metal and/or alkali metal chlorides are used in an amount of about 7 to 8 chlorine molecules for each sulfur molecule contained in the coal.

The catalyst of the present invention comprises one or more deliquescent halogen salts, barium chloride, potassium chloride or mixtures thereof, and one or more reducing oxides, one or more chromate salts or mixtures thereof, provided that if potassium chloride is not present in the aqueous slurry containing the extraction mixture, potassium fluoride or tannic acid is also present in the catalyst.

Examples of deliquescent halogen salts especially useful in the present invention include calcium chloride, magnesium chloride and mixtures thereof.

Examples of reducing oxides include chromic oxide, magnanese dioxide and iron (III) oxide.

Examples of chromate salts include potassium dichromate and sodium chromate.

The components of the catalyst are generally present in the following amounts: deliquescent halogen salt(s), barium chloride, potassium chloride or mixtures thereof (about 90 to 95% by weight of the catalyst mixture); reducing oxide(s), chromate salt(s) or mixtures thereof (about 6 to 10% by weight of the catalyst mixture); if present, potassium fluoride or tannic acid (about 3 to 5% by weight of the catalyst mixture).

An especially preferred catalyst composition comprises, by total weight of the catalyst mixture, calcium chloride, magnesium chloride and/or potassium chloride in an amount of about 90 to 95% by weight; chromic oxide or chromate salts in an amount of about 3 to 5% by weight; manganese dioxide in an amount of about 3 to 5% by weight; and potassium fluoride in an amount of about 3 to 5% by weight if potassium chloride is not present in the aqueous slurry containing the extraction mixture.

Examples of compositions, but not necessarily amounts, of suitable catalysts are disclosed in U.S. Pat. No. 2,369,024 and U.S. Pat. No. 2,089,599 (incorporated herein by reference). These patents teach spraying of catalyst components on the coal prior to burning, which concentrates sulfur dioxide from the pyrites when the coal burns. Thus, it is indeed unexpected that such catalyst components would be useful in an aqueous slurry of coal or other carbonaceous materials in order to desulfurize the material particularly because the desulfurization process of the present invention alleviates sulfur dioxide emissions rather than concentrates these emissions.

The catalyst is used in an amount of about 1 to 10% by weight of the total sulfur in the solids, i.e., coal or other carbonaceous materials, and preferably in an amount of about 2 to 10% by weight of the total sulfur in the solids. The amount of total sulfur present in the solids can be determined using routine chemical analysis.

The inorganic acid can be hydrochloric acid, nitric acid, hydrochloric acid and nitric acid, hydrochloric acid and ferric chloride, or nitric acid and ferric chloride. Nitric acid and a mixture of hydrochloric acid and ferric chloride are preferred.

The amount of acid used is the amount necessary to raise the pH of the begining solution to about 2–5.

Further, if iron is not present in the coal or other carbonaceous materials, then ferric chloride must be present in the aqueous slurry containing the extraction mixture. The ferric chloride can be added as such or formed in situ. The amount of iron is suitably about 0.5 to 3.0 lbs for each 100 lbs of coal or other carbonaceous materials being processed.

In the alternative embodiment, the hypochlorite can be calcium hypochlorite or sodium hypochlorite, preferably sodium hypochlorite.

Hypochlorite is used in an amount of about 100 gm of hypochlorite to 400 gm of water and 200 gm of coal or other carbonaceous material.

Further, in the alternative embodiment when hypochlorite is employed, the catalyst is the same as that described above. The amount of the catalyst used is about 1 to 10% by weight of the total sulfur in the solids, preferably about 2–10% by weight of the total sulfur in the solids. If inorganic acid is used along with the catalyst, the inorganic acid is used in an amount of about 1–5% by volume of a solution of the acid(s) to the final volume of the aqueous slurry containing the extration mixture.

As with the above embodiment, if iron is not present in the coal or other carbonaceous materials, then ferric chloride must be present in the extraction mixture in an amount of about 0.5 to 3.0 lbs for each 100 lbs of coal or other carbonaceous materials being processed.

The above-described formulations of metal chloride, catalyst and acid or hypochlorite and catalyst (or catalyst and acid) are contacted with the coal or other carbonaceous materials for a period of approximately 10 to 45 minutes, preferably about 30 minutes, with the addition of an oxidizing agent capable of reducing pyritic sulfides to a soluble state, such as oxygen gas, sulfur dioxide gas, oxygen enriched air, sulfur dioxide enriched air, or air. A suitable amount of the above described oxidizing agents is about 1–5 liters per minute, preferably about 1–2 liters per minute. The coal or other carbonaceous material is agitated with the extraction mixture at an elevated temperature below the oxidation temperature of the coal or other carbonaceous materials. A suitable temperature range is about 80° to 130° C. Further, it is preferred that the agitation be carried out at about atmospheric pressure. However, the pressure can range from about atmospheric pressure to over 500 psi, if no degradation of the carbonaceous material is encountered.

When the agitation is carried out at about atmospheric pressure, the temperature is preferably about 85° to 95° C.

Further, according to the present invention, the point at which the coal or other carbonaceous material is treated with the above-described formulations can be varied as follows: (1) the coal or other carbonaceous material may be wet ground and then transferred to a second reaction zone wherein the comminuted material is heat reacted with agitation in the presence of the alkaline earth metal and/or alkali metal chloride and catalyst and acid or the hypochlorite and catalyst (or catalyst and acid); (2) the coal or other carbonaceous materials may be wet ground in the presence of the alkaline earth metal and/or alkali metal chloride or the hypochlorite and then this aqueous solution transferred to an agitator wherein the slurry is heat reacted in the presence of the catalyst and acid or the catalyst (or catalyst and acid), respectively; and (3) the wet grinding and heat reaction with agitation may be accomplished simultaneously in the presence of the alkaline earth metal and/or alkali metal chloride and catalyst and acid or the hypochlorite and catalyst (or catalyst and acid), respectively. The oxidizing agent is added at the heat reacting step. If ferric chloride is added to the extraction mixture, the ferric chloride is preferably added at the heat reacting step but can be added at the wet grinding step.

Of the three above-described embodiments the second and third are preferred because grinding the coal or other carbonaceous material in the mixture markedly increases the amount of sulfur removed from the coal. This is believed to be due to the catalytic action of the acids and heat generated in the grinding zone which act to release the sulfur by conversion of some of the sulfides.

By following the above-described procedure, all types of sulfur found in the coal appear to become water soluble and susceptible to removal with hot water washing, a hot dilute acid wash or a hot alkaline wash. A hot dilute acid wash or a hot alkaline wash are preferred.

According to the present invention, the dilute acid wash can be any inorganic or organic acid. Examples of suitable inorganic acids include nitric acid, sulfuric acid and hydrochloric acid. Examples of suitable organic acids include paraacetic and acetic acid. Preferred acids are nitric acid and sulfuric acid. Nitric acid is particularly preferred. Nitric acid, even in dilute hot solutions, strongly oxidizes any sulfur films occluded to the solids and will also complete the dissolution of any sulfides that have started to break down in the processing, as well as aid in the removal of some organics that remain in a dissolution state.

A suitable acid concentration is about 5 to 10% by volume of a concentrated solution of the acid to the final volume of the wash solution.

Suitable alkaline washes include a solution of about 0.1 to 3 molar of ammonium hydroxide, sodium hydroxide or potassium hydroxide. A solution of about 0.1 molar to 0.2 molar is preferred. The concentration of the alkaline solution is limited however by the point at which the volatiles, or soluble carbon compounds start to break down which can be easily determined by one skilled in the art.

The temperature of the water, dilute acid or alkaline wash is about 90°–100° C., preferably just below boiling at atmospheric pressure. The wash is carried out for a period of time which can readily be determined by one skilled in the art. A suitable time is about 5 to 30 minutes, preferably about 15 minutes.

Although the above-described process of contacting comminuted coal with alkaline earth metal and/or alkali metal salts, catalyst and an acid or hypochlorite and a catalyst (or catalyst and acid) removes considerable amounts of the sulfur compounds from the coal, the coal must still be washed with a dilute acid wash or hot alkaline wash in order to obtain sulfur reduction sufficient to meet the EPA standards for burning coal, i.e., 1.2 lbs $SO_2$ emmissions per million BTU.

In a second embodiment of the present invention, removal of sulfur in the form of sulfate or other water soluble sulfur is preceded by a step in which an aqueous slurry of coal or other carbonaceous materials is treated at an elevated temperature below the oxidation temperature of said coal or other carbonaceous materials with a formulation comprising one or more alkaline earth metals and/or alkali metal chlorides or a mixture of the chlorides and nitric acid provided that if iron is not present in the coal or other carbonaceous material, ferric chloride is also present in the aqueous slurry containing the extraction mixture, whereby substantially all the sulfur extracted from the coal or other carbonaceous materials can be removed as elemental sulfur.

A suitable alkaline earth metal chloride is an alkaline earth metal chloride as described above with calcium chloride being preferred. Suitable alkali metal chlorides include, for example, sodium chloride and potassium chloride. A mixture of sodium chloride and potassium chloride is preferred and even more preferred is a mixture of equal parts by weight of sodium chloride and potassium chloride.

The alkaline earth metal and/or alkali metal chloride(s) can be added in a concentration of about 0.5–15% by weight of the aqueous solution. A concentration of about 15% by weight of the aqueous solution is preferred.

The nitric acid is varied between about 0.5 to 10% by volume of a concentrated solution of the acid to the final volume of the aqueous slurry depending upon the amount of total sulfur in the coal or other carbonaceous material. The particular amount of nitric acid within the range that can be used can readily be determined by one skilled in the art by monitoring the sulfur removal.

The coal or other carbonaceous material is reacted with the above-described components at an elevated temperature below the oxidation temperature of the coal or other carbonaceous materials. A suitable temperature range is about 80°–130° C.

The reaction pressure can range from about atmospheric pressure to over 500 psi if no degradation of the carbonaceous material is encountered. However about atmospheric pressure is preferred.

When the reaction is carried out at atmospheric pressure, the mixture is preferably reacted at a temperature of about 85°–130° C., and more preferably about 85°–90° C.

The reaction is carried out for a period of about 10–30 minutes preferably about 15 minutes without the use of added oxygen, oxygen enriched air, or air.

The reaction may also be carried out in the presence of added oxygen, oxygen enriched air, or air in an amount of about 1–2 liters per minute, for a period of about 15–30 minutes. The oxygen, oxygen enriched air or air is used in the presence of the nitric acid.

As with the first embodiment, if ferric chloride is added to the reaction mixture, the ferric chloride is added in an amount of about 0.5 to 3.0 lbs iron for each 100 lbs of coal being processed.

After reaction, the solids can be separated from the liquid while hot and elemental sulfur recovered from the liquid by known means such as, for example, by using a sulfur precipitant. Examples of suitable sulfur precipitants include sodium citrate (as described in United States Bureau of Mines report of investigations—1981, RI 8540 by W. N. Marchant, et al) and acidic solutions, such as an aqueous solution of hydrochloric acid. Since chlorine is present in the circuit with sulfur, elemental sulfur can also be precipitated with hydrogen iodide or an aqueous solution of hydrogen iodide, i.e., hydriodic acid (HI). As much as 85% of the sulfur can possibly be recovered by this intermediate step.

This intermediate treatment for recovering elemental sulfur can be performed in three embodiments just as the steps for recovering sulfate and other soluble sulfurs. That is, the following combinations are possible: (1) the coal or other carbonaceous material can be wet ground and then heat reacted in the presence of alkaline earth and/or alkali metal chloride(s) and nitric acid; (2) the coal or other carbonaceous material can be wet ground in the presence of the alkaline earth and/or alkali metal chloride(s) and this solution heat reacted with nitric acid; and (3) the wet grinding and heat reacting can be carried out simultaneously in the presence of the alkaline earth and/or alkali metal chloride(s) and nitric acid. As with the first embodiment, if ferric chloride is added to the extraction mixture, the ferric chloride is preferably added at the heat reacting step but can be added at the agitation step.

The solids separated from the extraction mixture are desirably washed with hot water, hot dilute acid or a hot alkaline solution as described above. A hot acid or alkaline solution is preferred and a hot acid solution is especially preferred.

After carrying out the intermediate steps, the solids are then reagitated with a new solution containing alkaline earth and/or alkali metal chloride(s) and an inorganic acid or with a solution containing one of the above-described formulations of (a) alkaline earth metal and/or alkali metal chloride(s) and acid and catalyst or (b) hypochlorite(s) and catalyst (or catalyst and acid), at a temperature below the oxidation temperature of the coal or other carbonaceous material and in the presence of an oxidizing agent capable of reducing pyritic sulfides to a soluble state, such as oxygen gas, sulfur dioxide gas, oxygen enriched air, sulfur dioxide enriched air or air, as described above, to remove further sulfur as sulfate before the coal is finally washed with hot water, hot dilute acid or a hot alkaline solution and burned. If iron is not present in the coal or other carbonaceous material, then ferric chloride must be present in the reagitation extraction mixture in the same amount as described above.

When the solids are reagitated with an alkaline earth metal and/or alkali metal chloride and an inorganic acid, the alkaline earth and/or alkali metal chloride can be the same as those described in the second embodiment for treating the coal or other carbonaceous materials to extract sulfur as elemental sulfur. The inorganic acid can be the same as those described in the first embodiment for treating the coal or other carbonaceous materials to extract sulfur as sulfate or other water soluble sulfurs. However, nitric acid is preferred.

The alkaline earth and/or alkali metal chloride is used in an amount of about 0.5 to 5% by weight final concentration, preferably about 0.5 to 2% by weight final concentration.

The acid is used in an amount of about 1.25% to 5% of a concentrated solution to the final aqueous volume, preferably about 1.25% to 3%.

The amount of oxidizing agent, the temperature and pressure conditions, and time parameters are the same as those described in the first embodiment for extracting sulfur as sulfate or other water soluble sulfurs.

After reagitation, the separated solids are washed with hot water, hot dilute acid or a hot alkaline solution as described above for the first embodiment.

As a further desirable step in all of the above-described embodiments, there can be a last washing with a dilute solution of potassium chromates or potassium fluoride in order to reduce corrosion and slagging when the coal is burned. This is not an essential step but is preferred. A suitable amount of potassium chromate or potassium fluoride is 1% weight to volume.

As earlier described, fine grinding of the solids facilitates a rapid and complete reaction between sulfur impurities in the solids and chemicals in the extraction mixture. The solids-extraction mixture reactions are exothermic and raise the temperature of the extraction mixture slurry from ambient temperature to a temperature as high as 50° C. Thus, the only additional heat necessary while the extraction mixture is maintained in contact with comminuted solids is a quantity of heat which will raise the temperature of the extraction mixture slurry from about 50° C. to 80° C.

Further, the rapid, almost instantaneous reaction between the solids and the extraction mixture chemicals causes violent foaming and, therefore, it is desirable to include an emulsifier in the extraction mixture slurry in order to increase efficiency of the process. A suitable commercially available emulsifier useful in the present invention is DB-110A manufactured by Dow-Corning which is a non-ionic emulsifier. The emulsifier is used in an amount of 2 to 5 gms of a 2% solution of emulsifier to one liter of aqueous coal slurry.

The coal and extraction mixture are preferably combined and agitated in a closed reaction vessel both to retain heat generated by the exothermic chemical reactions which occur and to reduce the quantity of chemical reagents which escape into the air during the agitation of the extraction mixture slurry. Since only a portion of each chemical component in the extraction mixture is normally consumed during treatment of a quantity of coal, the extraction mixture can be separated from the desulfurized, treated solids, replenished with the necessary amount of each extraction chemical and then recycled for treatment of another quantity of solids. The extraction mixture solution is periodically processed to remove sulfur or sulfates and is then replenished or recycled or is simply discarded. Carrying out agitation of the coal and extraction mixture in a closed reactor vessel conserves reaction chemicals and decreases the amount of new chemicals which must be added to recycled extraction mixtures.

Sulfate and other soluble sulfur compounds are removed from the spent extraction mixture solution by known means, such as by precipitation with calcium salts or barrium chloride.

When the comminuted solids and the extraction mixture are initially combined, the pH of the liquid component of the extraction mixture solution is approximately 2 to 5. After the extraction mixture solution has contacted the solids for approximately 15 minutes, the pH of the solution is approximately 0.1. After comminuted solids are separated from the extraction mixture solution by any conventional means, the solids are washed with hot water, a hot alkaline solution or a dilute acid, as described above. The water, alkaline or acid wash removes soluble sulfur compounds and sulfates along with organic sulfur compounds which adhere to the solids during the separation of the solids from the extraction mixture solution. Washed solids are dried using any conventional means, for example, under vacuum or with steam to remove moisture or occluded acids carried by the solids. Since the solids have been finely ground, care must be taken not to expose the solids to a source of oxygen while the solids are hot.

Washed, dried solids can be fed directly into a boiler for combustion, may be moved as slurry by pipeline to another plant, or may be pelletized or briquetted for shipment, storage and subsequent sale and use.

Further, although the invention has been described as a continuous process, a modified batch process, i.e., a semicontinuous circuit, can also be used.

The overall integrated process for producing sulfur-purified coal on site at open pit or underground coal-mining operations will now be described by reference to the Figures.

FIG. 1 illustrates one embodiment of the present invention wherein all the extracted sulfur is extracted as sulfate or other soluble sulfur compounds. Crushed raw coal 1 is wet ground 2 in combination with water 3 and a mixture 4 of potassium chloride and sodium chloride. The ground coal slurry 5 is then agitated in a heat reactor 6 with the addition of oxygen gas or air 7, catalyst 8, and nitric acid 9 to produce sulfate and other soluble sulfur compounds. The coal may be agitated in the heat reactor at any desired pressure. The temperature of the mixture in the heat reactor may be increased by supplying heat which is a by-product of a plant which manufactures any of the components used in the present process. After agitating for about 15 minutes, the reacted coal slurry 10 is separated 11 into a liquid component 16 and a solid component 12. The solid component 12 is washed 13 in hot water, dilute acid or an alkaline solution to produce desulfurized coal 14. The wash solution may be recycled 15.

Sulfate 19 is periodically recovered 17 from the liquid 16 from the coal liquid separation. The liquid 16 or 17 may be recycled for use in the agitated heat reactor 6. When extraction mixtures are recycled, fresh chemicals are added to bring the strength of each chemical in the solution up to an acceptable level within the ranges hereinbefore described.

FIG. 2 illustrates a second embodiment of the present invention wherein elemental sulfur is recovered midway through the extraction process. Crushed raw coal 1 is wet ground 2 in the presence of sodium chloride and potassium chloride salts 20 and water 3. The ground coal slurry 5 is then agitated in a heat reactor 21 in the presence of nitric acid 22. The reacted coal slurry 23 is separated 24 into a solid component 25 and a pregnant sulfur liquid component 26. The coal solids 25 are washed 31 with hot water, dilute acid or alkaline solution and the washed coal solids 32 are again agitated in a second heat reactor 6 in the presence of sodium chloride and potassium chloride salts 4, nitric acid 8, and oxygen gas or air 7. The reacted coal slurry 10 is then subjected to further process steps, the same as described in FIG. 1.

For elemental sulfur recovery 27, a sulfur precipitant 28 is contacted with the pregnant sulfur liquid 26 to produce elemental sulfur 29. The liquid 30 having elemental sulfur removed can be cycled to the agitated heat reactor 6, and this is especially desirable if an acid process has been used to recover the elemental sulfur.

The present invention is a significant improvement over the prior art. To accomplish the invention, it is preferred to locate the processing facilities near or adjacent to the power producing plants. This gives a source of inexpensive energey which is now being wasted and a source of water, particularly that used in the cooling towers of most large power plants. These waters in many cases may contain chemicals that can be used to advantage in practicing the present invention, especially chromates or chromium which is added to the cooling towers to prevent scaling, and is lost unless a system is installed to recover the metals from the cooling waters. The cooling waters can contain as much as 800 ppm chromates. These chromates can be utilized in the invention.

Further, since natural brine or sea water contains many of the components of the extraction mixture of the present invention, natural brine or sea water could possibly be used in the extraction mixture and, therefore, the present invention is also particulary desirable when the desulfurization facilities are located near brine deposits and sea water.

In view of the present invention, it is also apparent that the coal desulfurization plants should be located near the burning plants. In this way, another noxious product could be utilized to reduce the cost of processing and the cause of pollution. This material is known as $NO_x$ or nitrous oxide. Nitrous oxide isolated from coal emissions by several known means, for example, magnet hydrodynamics, can be converted to nitric acid for use with the extraction mixture of the present invention.

The present invention will now be described by reference to the following specific examples which are not intended to be limiting.

EXAMPLE I

A sample of Ohio #6 seam, raw coal, crushed to 100 mesh, was analyzed. The results are shown in Table A. Unless otherwise indicated, all parts, percents, ratios and the like are by weight.

TABLE A

| Ohio #6 - Seam Raw Coal | | | |
|---|---|---|---|
| Component | As Received Basis | Dry Basis | Moisture & Ash Free |
| Moisture | 9.79 | — | — |
| Ash | 24.69 | 27.37 | — |
| Sulfur | 3.71 | 4.11 | — |
| Heating Value, BTU/lb. | 9,079 | 10,064 | 13,857 |

Grinding And Extraction 200 gms of the above Ohio #6 coal were ground to 100 mesh, and then mixed in a stirred reaction vessel at 85°-90° C. for 30 minutes in the presence of 1000 ml water, 15 gm of a mixture of NaCl and ·KCl, 15 ml concentrated, i.e., about 37% wt./wt., hydrochloric acid, 10 ml ferric chloride (30% wt./wt. solution), and 5 gm catalyst comprising 90% MgCl, 5% maganese dioxide and 5% chromic oxide. The salt mixture of 15% by wt of the solution was 7.5% NaCl and 7.5% KCl.

Coal recovered from the extraction mixture was washed with hot dilute nitric acid (50 ml of 69% to 71% nitric acid to 1000 ml of solution) for 15 minutes with agitation.

The coal was then separated from the wash liquid and the coal analyzed for sulfur content. The results are shown in Table B below.

TABLE B

| Ohio #6 - Treated Raw Coal | | |
|---|---|---|
| Component | As Treated Basis | Dry Basis |
| Moisture, % | 2.11 | — |
| Ash, % | 11.62 | 11.87 |
| Volatile Matter, % | 35.30 | 36.08 |
| Fixed Carbon, % | 50.97 | 52.05 |
| Total Sulfur, % | 0.99 | 1.01 |
| Organic Sulfur, % | 0.73 | 0.74 |
| Pyritic Sulfur, % | 0.26 | 0.27 |
| Sulfate Sulfur, % | <0.01 | <0.01 |
| Gross Calorific Value, BTU/lb. | 10,760 | 10,997 |

The results indicate that there was about a 76% reduction in total sulfur on both an as treated basis and dry basis.

EXAMPLES II-III

A sample of washed, i.e., sink floated, Ohio #6 coal was analyzed. The results are shown below in Table C.

TABLE C

| Sink Floated Ohio #6 Coal | | | |
|---|---|---|---|
| Component | As Received Basis | Dry Basis | Moisture and Ash Free |
| Moisture | 14.66 | — | — |
| Ash | 11.04 | 12.94 | — |
| Sulfur | 3.46 | 4.05 | — |
| Heating Value, BTU/lb. | 10,574 | 12,390 | 14,232 |

Grinding And Extraction

Sample 1A 200 gms of the above Ohio #6 sink floated coal was heated with agitation for 30 minutes at a temperature of 80°-85° C. in the presence of 600 ml water, 15 gm NaCl, 15 ml concentrated, i.e., about 37% wt./wt., hydrochloric acid, and 10 ml of a 100% wt./wt. solution of catalyst comprising 90% calcium chloride, 5% chromic oxide and 5% manganese dioxide. Air was bubbled into the solution at a rate of 1 liter per minute.

The separated coal was analyzed for sulfur content and the results are shown in Table D.

TABLE D

| Ohio #6 - Sink Floated 1A Coal | | |
|---|---|---|
| Component | As Treated Basis | Dry Basis |
| Moisture, % | 1.81 | — |
| Ash, % | 12.72 | 12.94 |
| Volatile Matter, % | 34.56 | 35.20 |
| Fixed Carbon, % | 50.91 | 51.86 |
| Total Sulfur, % | 1.33 | 1.35 |
| Organic Sulfur, % | 0.30 | 0.31 |
| Pyritic Sulfur, % | 1.03 | 1.04 |
| Sulfate Sulfur, % | <0.01 | <0.01 |
| Gross Calorific Value, BTU/lb. | 12,160 | 12,379 |

The results indicate that about 60% of the sulfur on an as treated basis was removed and about 67% of the sulfur on a dry basis was removed.

Sample 1B 200 gms of the above Ohio #6 washed coal (Table C), ground to 100 mesh was reacted for 30 minutes at 80°-85° C. in the presence of 800 ml water, 15 gm NaCl, 20 ml concentrated, i.e., about 37% wt./wt., hydrochloric acid and 5 ml of a 100% wt./wt. solution of catalyst comprising 45% MgCl, 45% CaCl, 5% $MgO_2$, and 5% chromic oxide. Air was bubbled into the solution at a rate of 1 liter per minute.

The separated coal was analyzed for sulfur content and the results are shown in Table E below.

TABLE E

| Ohio #6 - Sink Floated 1B Coal | | |
|---|---|---|
| Component | As Treated Basis | Dry Basis |
| Moisture, % | 1.12 | — |
| Ash, % | 11.67 | 11.80 |
| Volatile Matter, % | 34.38 | 34.77 |
| Fixed Carbon, % | 52.83 | 53.43 |
| Total Sulfur, % | 2.07 | 2.09 |
| Organic Sulfur, % | 1.07 | 1.08 |
| Pyritic Sulfur, % | 0.96 | 0.97 |
| Sulfate Sulfur, % | 0.04 | 0.04 |
| Gross Calorific Value, BTU/lb. | 12,160 | 12,294 |

The results indicate that about 40% of the sulfur on an as treated basis was removed and about 48% of the sulfur on a dry basis was removed.

EXAMPLE IV 100 gms of the above Ohio #6 washed coal (Table C), ground to 100 mesh was reacted with agitation at approximately 90° C. for 30 minutes with 500 ml water, 15 gm NaCl/KCl mix (50/50 by weight), and 500 ml 10% nitric acid (prepared by mixing 10 volumes of 69 to 71% nitric acid to 90 volumes of water), in the absence of added air or oxygen. The slurry was filtered and the coal washed with 500 ml of 10% nitric acid (prepared as above). The separated acid washed coal was analyzed for sulfur content and the results are shown in Table F below:

TABLE F

| Ohio #6 - Sink Floated 2 Coal | | |
|---|---|---|
| Component | As Treated Basis | Dry Basis |
| Moisture, % | 0.97 | — |
| Ash, % | 11.80 | 11.91 |
| Volatile Matter, % | 34.16 | 34.50 |
| Fixed Carbon, % | 53.07 | 53.57 |
| Total Sulfur, % | 1.22 | 1.23 |
| Organic Sulfur, % | −0.01 | −0.01 |
| Pyritic Sulfur, % | 1.18 | 1.19 |
| Sulfate Sulfur, % | 0.04 | 0.04 |
| Gross Calorific Value, BTU/lb. | 11,983 | 12,106 |

The results indicate that about 65% of the total sulfur was removed from the coal on an as treated basis and about 70% of the total sulfur was removed from the coal on a dry basis. Further, 100% of the organic sulfur was removed from the coal on an as treated, as well as a dry basis.

EXAMPLE V

A sample of Ohio #6 raw coal (Table A) was extracted as in Example I above and the coal recovered from the extraction mixture was subjected to various washes to determine the nature and amounts of sulfur, total solids at 180° C., non-volatile solids at 550° C., i.e., and iron being removed. The results are shown in Table G below.

TABLE G

| Samples Marked | Total Sulfur | Total Solids @ 180° C. | Non-Volatile Solids @ 550° C. | Iron | Weight of Precip. |
|---|---|---|---|---|---|
| Ohio 6: | | | | | |
| Acid Wash | 0.15 g/L | 1.79 g/L | 1.32 g/L | — | — |
| Water Wash | 0.04 | 0.29 | 0.22 | — | — |
| Alkaline Wash (2.4%) | 0.93 | 7.58 | 6.38 | 0.73 g/L | — |
| Alkaline Wash (5%) | 1.24 | 172.3 | 168.5 | — | — |
| Special | 0.03 | — | — | — | 0.32 g |

The acid wash was a wash with 10% nitric acid (prepared by mixing 10 volumes of 69–71% nitric acid with 90 volumes of water) at about 85° C. for 15 minutes. The analysis of the spent acid wash solution indicates that sulfur was washed from the coal in soluble form and that ash is carried along with the wash solution. A small amount of volatiles was removed. This could be organic sulfur.

The water wash was a wash of the acid washed coal with water at about 85° C. for 15 minutes. The analysis of the spent water wash indicates that only a small amount of occluded solids, which include sulfur and ash, remained on the coal after the acid wash suggesting the acid wash was highly efficient at removing any occluded solids left after extraction.

The 2.4% alkaline wash was a wash of the extracted coal with 2.4% ammonium hydroxide at about 85° C. for 15 minutes. The analysis of the spent 2.4% alkaline wash solution indicates that the alkaline wash was superior to the acid wash for removing sulfur and ash. However, the alkaline wash removed more total solids than the acid wash indicating that more volatiles may have been removed which would result in a concomitant decrease in the gross caloric value of the coal.

The 5% alkaline wash was a wash of the extracted coal with 5% ammonium hydroxide at about 85° C. for 15 minutes. The analysis of the spent 5% alkaline wash solution indicates that extraction of a very high amount of sulfur, ash, and total solids occurred. The large amount of total solids removed could be due to removal of volatiles which would result in a concomitant decrease in the gross caloric value of the coal.

The special sample was extraction liquid after extraction had been carried out for ten minutes. The analysis of the extraction liquid indicates that at least some sulfur was already removed after reaction with the extraction mixture for only ten minutes.

While the invention has been described in detail, and with reference to specific embodiments thereof, it will be apparent to one skilled in the art that various changes and modifications can be made therein without departing from the spirit and scope thereof.

I claim:

1: A process for removing sulfur and ash from coal and other carbonaceous materials which contain pyritic sulfur, sulfides, elemental sulfur, organic sulfur and/or sulfate sulfur which comprises the steps of:

(I) treating an aqueous slurry of said coal or other carbonaceous materials at an elevated temperature below the oxidation temperature of said coal or other carbonaceous materials and in the presence of an oxidizing agent capable of reducing pyritic sulfides to a soluble state with:

(A) a formulation comprising:

(1) one or more alkaline earth metal chlorides, one or more alkali metal chlorides or a mixture of said chlorides, and (2) a treating agent comprising:

(a) a catalyst comprising:

(i) one or more deliquescent halogen salts, barium chloride, potassium chloride, or mixtures thereof, and (ii) one or more reducing oxides, one or more chromate salts or mixtures thereof, (iii) provided that if potassium chloride is not present in said slurry containing said formulation (A), potassium fluoride or tannic acid is also present in said calalyst; and (b) an inorganic acid selected from the group consisting of:

(i) hydrochloric acid, (ii) nitric acid, (iii) hydrochloric acid and nitric acid, (iv) hydrochloric acid and ferric chloride, and (v) nitric acid and ferric chloride, (3) provided that if iron is not present in the coal or other carbonaceous material, then ferric chloride is present in said slurry containing in said formulation (A), or (B) a formulation comprising:

(1) a hypochlorite or a mixture of hypochlorites, and (2) a treating agent comprising one member selected from the group consisting of:

(a) a catalyst comprising:

(i) one or more deliquescent halogen salts, barium chloride, potassium chloride or mixtures thereof, and (ii) one or more reducing oxides, one or more chromate salts or mixtures thereof, (iii) provided that if potassium chloride is not present in said slurry containing said formulation (A), potassium fluoride or tannic acid is also present in said catalyst; and (b) a mixture of (a) and an inorganic acid selected from the group consisting of (i) hydrochloric acid, (ii) nitric acid, (iii) hydrochloric acid and nitric acid, (iv) hydrochloric acid and ferric chloride, and (v) nitric acid and ferric chloride, (3) provided that if iron is not present in the coal or other carbonaceous material ferric chloride is present in said slurry containing said formulation (B); whereby substantially all the sulfur extracted from said coal or other carbonaceous materials is converted to sulfate sulfur or other water soluble sulfurs;

(II) separating said coal or other carbonaceous materials from solution; and (III) washing the separated coal or other carbonaceous materials.

2. A process as in claim 1, wherein said treating step (I) comprises the substeps of:

(I') wet grinding said coal or other carbonaceous materials; and (I'') agitating, at an elevated temperature below the oxidation temperature of said coal or other carbonaceous materials and in the presence of said oxidizing agent, the aqueous mixture of substep (I') with said formulation (A) or said formulation (B).

3. A process as in claim 2, wherein said wet grinding and agitating is performed simultaneously.

4. A process as in claim 1, wherein said treating step (I) with said formulation (A) comprises the substeps of:

(I') wet grinding said coal or other carbonaqeous materials in the presence of said one or more alkaline earth metal chlorides, said one or more alkali metal chlorides or said mixture thereof, and (I'') agitating, at an elevated temperature below the oxidation temperature of said coal or other carbonaceous materials and in the presence of said oxidizing agent, the aqueous mixture of substep (I') with said treating agent of formulation (A).

5. A process as in claim 1, wherein said treating step (I) with said formulation (B) comprises the substeps of:

(I') wet grinding said coal or other carbonaceous materials in the presence of said hypochlorite or mixtures thereof, and (I'') agitating, at an elevated temperature below the oxidation temperature of said coal or other carbonaceous materials and in the presence of said oxidizing agent, the aqueous mixture of substep (I') with said treating agent of formulation (B).

6. A process for removing sulfur and ash from coal and other carbonaceous materials which contain pyritic sulfur, sulfides, elemental sulfur, organic sulfur and/or sulfate sulfur which comprises the steps of:

(I) treating an aqueous slurry of said coal or other carbonaceous materials at an elevated temperature below the oxidation temperature of said coal or other carbonaceous materials with a formulation comprising one or more alkaline earth metal chlorides, one or more alkali metal chlorides or a mixture of said chlorides and nitric acid, provided that if iron is not present in said coal or other carbonaceous material, ferric chloride is also present, whereby substantially all the sulfur extracted from said coal or other carbonaceous materials can be removed as elemental sulfur;

(II) separating said coal or other carbonaceous materials from solution;

(III) agitating the separated coal or other carbonaceous materials, at an elevated temperature below the oxidation temperature of said coal or other carbonaceous materials and in the presence of an oxidizing agent capable of reducing pyritic sulfides to a soluble state in an aqueous mixture containing:

(A) a formulation comprising:

(1) one or more alkaline earth metal chlorides, one or more alkali metal chlorides or a mixture of said chlorides, and (2) a treating agent comprising one member selected from the group consisting of:

(a) an inorganic acid selected from the group consisting of:

(i) hydrochloric acid, (ii) nitric acid, (iii) hydrochloric acid and nitric acid, (iv) hydrochloric acid and ferric chloride, and (v) nitric acid and ferric chloride, and (b) mixtures of (a) and a catalyst comprising:

(i) one member selected from the group consisting of one or more deliquescent halogen salts, barium chloride, potassium chloride and mixtures thereof, and (ii) one or more reducing oxides, one or more chromate salts or mixtures thereof, (iii) provided that if potassium chloride is not present in said slurry containing said formulation (A), potassium fluoride or tannic acid is also present in said catalyst, (3) provided that if iron is not present in said coal or other carbonaceous material, then ferric chloride is present in said slurry containing said formulation (A); or (B) a formulation comprising:

(1) a hypochlorite or mixtures of hypochlorites, and (2) a treating agent comprising one member selected from the group consisting of:
(a) a catalyst comprising:
(i) one or more deliquescent halogen salts, barium chloride, potassium chloride or mixtures thereof, and
(ii) one or more reducing oxides, one or more chromate salts or mixtures thereof,
(iii) provided that if potassium chloride is not present in said slurry containing said formulation (B), potassium fluoride or tannic acid is also present in said catalyst, and
(b) a mixture of (a) and an inorganic acid selected from the group consisting of:
(i) hydrochloric acid,
(ii) nitric acid,
(iii) hydrochloric acid and nitric acid,
(iv) hydrochloric acid and ferric chloride, and
(v) nitric acid and ferric chloride,
(3) provided that if iron is not present in said coal or other carbonaceous material, ferric chloride is present in said slurry containing said formulation (B), whereby substantially all the sulfur extracted from said separated coal or carbonaceous materials is converted to sulfate sulfur or other water soluble sulfurs;

(IV) again separating said coal or other carbonaceous materials from solution, and (V) washing the again separated coal or other carbonaceous materials.

7. The process of claim 6, wherein said treating step (I) comprises the substeps of:

(I') wet grinding said coal or other carbonaceous materials, and (I'') agitating, at an elevated temperature below the oxidation temperature of said coal or other carbonaceous materials, the aqueous mixture of substep (I') with said one or more alkaline earth metal chlorides, said one or more alkali metal chlorides or said mixture thereof and nitric acid.

8. A process as in claim 7, wherein said wet grinding and agitating is performed simultaneously.

9. A process as in claim 6, wherein said treating step (I) comprises the substeps of:

(I') wet grinding said coal or other carbonaqueous materials in the presence of said one or more alkaline earth metal chlorides, said one or more alkali metal chlorides or said mixture of chlorides, and (I'') agitating, at an elevated temperature below the oxidation temperature of said coal or other carbonaceous materials, the aqueous mixture of substep (I') with said nitric acid.

10. The process of claim 6, further comprising the step of an additional washing of the coal or other carbonaceous material between said steps (II) and (III).

11. The process of claim 6, wherein oxygen gas, oxygen enriched air, or air is added with said nitric acid during said treating step (I).

12. The process of claim 6, wherein elemental sulfur is recovered from the solution of step (II).

13. The process of claim 11, wherein elemental sulfur is recovered from the solution of step (II).

14. The process of claim 1, wherein said coal is raw coal.

15. The process of claim 6, wherein said coal is raw coal.

16. The process of claim 10, wherein said coal is raw coal.

17. The process of claim 11, wherein said coal is raw coal.

18. The process of claim 12, wherein said coal is raw coal.

19. The process of claim 13, wherein said coal is raw coal.

20. The process of any one of claims 1 to 19 additionally comprising the step of washing the washed coal or other carbonaceous materials with a dilute solution of potassium fluoride or potassium chromate.

21. The process of any one of claims 1 to 19, wherein said washing in the last steps is with a dilute acid.

22. The process of claim 21, wherein said dilute acid is nitric acid.

23. The process of any one of claims 1 to 19, wherein said washing in the last steps is with an aqueous alkaline solution.

24. The process of claim 23, wherein said aqueous alkaline solution is ammonium hydroxide, sodium hydroxide or potassium hydroxide.

25. The process of any one of claims 6, 7, 8, 9, 10, 11, 12, 13, 15, 16, 17, 18 or 19, wherein step (I) is carried out at about atmospheric pressure and said elevated temperature of step (I) is about 85° to 130° C.

26. The process of any one of claim 1, 2, 3, 4, 5 or 14, wherein step (I) is carried out at about atmospheric pressure.

27. The process of any one of claims 6, 7, 8, 9, 10, 11, 12, 13, 15, 16, 17, 18 or 19, wherein step (III) is carried out at about atmospheric pressure.

28. The process of any one of claims 1, 2, 3, 4, 5 or 14, wherein step (I) is carried out at about atmospheric pressure and said elevated temperature of step (I) is about 85° to 95° C.

29. The process of any of claims 6, 7, 8, 9, 10, 11, 12, 13, 15, 16, 17, 18 or 19, wherein step (III) is carried out at about atmospheric pressure and said elevated temperature of step (III) is about 85° to 95° C.

30. The process of any one of claims 1 to 19, wherein said one or more alkali metal chlorides is sodium chloride, potassium chloride or mixtures thereof.

31. The process of claim 30, wherein said one or more alkali metal chlorides is a mixture of sodium chloride and potassium chloride.

32. The process of any one of claims 1 to 19, wherein said one or more alkaline earth metal chlorides is calcium chloride.

33. The process of any one of claims 1 to 19, wherein said one or more deliquescent halogen salts is calcium chloride or magnesium chloride.

34. The process of any one of claims 1 to 19, wherein said one or more reducing oxides is chromic oxide, manganese dioxide or iron (III) oxide.

35. The process of any one of claims 1 to 19, wherein said one or more reducing oxides is a mixture of chromic oxide and manganese dioxide.

36. The process of any one of claims 1 to 19, wherein said catalyst comprises:
(i) one or more deliquescent halogen salts, barium chloride, potassium chloride or mixtures thereof, in an amount of about 90 to 95% by weight,
(ii) one or more reducing oxides, one or more chromate salts or mixtures thereof in an amount of about 6 to 10% by weight, and
(iii) if present, potassium fluoride or tannic acid in an amount of about 3 to 5% by weight.

37. The process of any one of claims 1 to 19 wherein said catalyst comprises:

(i) one or more deliquescent halogen salts, barium chloride, potassium chloride or mixtures thereof, in an amount of about 90 to 95% by weight,
(ii) chromic oxide or one or more chromate salts in an amount of about 3 to 5% by weight,
(iii) manganese dioxide in an amount of about 3 to 5% by weight, and
(iv) if present, potassium fluoride or tannic acid in an amount of about 3 to 5% by weight.

38. The process of claim 36, wherein said catalyst is present in an amount of about 2 to 10% by weight of the total sulfur in said coal or other carbonaceous materials.

39. The process of claim 37, wherein said catalyst is present in an amount of about 2 to 10% by weight of the total sulfur in said coal or other carbonaceous materials.

40. The process of any one of claims 1 to 19, wherein said catalyst is present in an amount of about 2 to 10% by weight of the total sulfur in said coal or other carbonaceous materials.

41. The process of any one of claims 1 to 5 or 14, wherein:
(1) said alkali metal chloride is sodium chloride, and
(2) said treating agent is a mixture of:
(a) magnesium chloride, chromic oxide or chromate salts, manganese dioxide and potassium fluoride, and
(b) hydrochloric acid and ferric chloride.

42. The process of any one of claims 1 to 5 or 14, wherein:
(1) said alkali metal chloride is a mixture of sodium chloride and potassium chloride, and
(2) said treating agent is a mixture of:
(a) said catalyst, and
(b) nitric acid.

43. The process of claim 41, wherein said step (I) is performed at about atmospheric pressure and said elevated temperature is about 85° to 95° C.

44. The process of claim 42, wherein said step (I) is performed at about atmospheric pressure and said elevated temperature is about 85° to 95° C.

45. The process of any one of claims 6, 7, 8, 9, 10, 11, 12, 13, 15, 16, 17, 18, or 19, wherein:
(1) said alkali metal chloride of step (I) is a mixture of sodium chloride and potassium chloride,
(2) said alkali metal chloride of step (II) is a mixture of sodium chloride and potassium chloride, and
(3) said treating agent of formulation (A) of step (III) is nitric acid.

46. The process of claim 45, wherein said step (III) is performed at about atmospheric pressure and said elevated temperature is about 85° to 95° C.

47. The process of claim 10, wherein said washing between steps (II) and (III) is with nitric acid.

48. The process of any one of claims 1 to 19 wherein said oxidizing agent is oxygen gas, sulfur dioxide gas, oxygen enriched air, sulfur dioxide enriched air or air.

* * * * *